United States Patent [19]

Treplin et al.

[11] 4,135,574

[45] Jan. 23, 1979

[54] DEVICE FOR RECOVERING CLEANING ELEMENTS FROM A HEAT-EXCHANGER STREAM

[75] Inventors: Friedrich-Wilhelm Treplin, Ratingen; Werner Borchert, Ratingen-Tiefenbroich, both of Germany

[73] Assignee: Ludwig Taprogge, Reinigungsanlagen für Röhren-Wärmeaustauscher, Düsseldorf, Germany

[21] Appl. No.: 781,488

[22] Filed: Mar. 25, 1977

[30] Foreign Application Priority Data

Mar. 26, 1976 [DE] Fed. Rep. of Germany ..... 2612905

[51] Int. Cl.[2] ..... F28G 1/00

[52] U.S. Cl. ..... 165/95; 165/119; 15/3.51; 210/175; 209/17

[58] Field of Search ..... 165/95, 119; 134/8; 15/3.5, 3.51; 210/175, 187; 209/21–27, 17

[56] References Cited

U.S. PATENT DOCUMENTS

| | | | |
|---|---|---|---|
| 2,864,587 | 12/1958 | Broman | 165/95 |
| 2,946,569 | 7/1960 | Kirkby | 165/95 |
| 3,021,117 | 2/1932 | Taprogge | 165/95 |
| 3,872,920 | 3/1975 | Honma et al. | 15/3.51 |
| 3,919,732 | 11/1975 | Honma et al. | 165/95 X |
| 3,978,917 | 9/1976 | Honma et al. | 15/3.51 |
| 4,018,262 | 4/1977 | Jaschinski et al. | 165/95 X |

*Primary Examiner*—Ira S. Lazarus
*Attorney, Agent, or Firm*—Karl F. Ross

[57] ABSTRACT

A device for recovering cleaning elements, such as form-rubber balls or other particles, from a heat-exchanger stream traversing a tube-bundle heat exchanger comprises a vertically oriented cylindrical housing or duct traversed axially by the main stream of heat-exchanger fluid and at least one separating sieve built into the housing for intercepting particles entrained in the stream and recovering them therefrom. The separating sieve is inclined to the axis of the housing and has, at least partially, an ellipsoidal boundary where it meets the inner wall of the housing. At the lower part of the sieve a collecting tube is provided, along the ellipsoidal boundary, and is formed with a laterally open longitudinally extending slit constituted a mouth through which the particles pass into this tube. A fitting at the low point of the tube conducts the collected particles from the collecting tube. The heat exchange stream flows in part tangentially into the collecting tube through the slit to induce the particles to pass cleanly from the sieve into this mouth.

10 Claims, 4 Drawing Figures

DEVICE FOR RECOVERING CLEANING ELEMENTS FROM A HEAT-EXCHANGER STREAM

FIELD OF THE INVENTION

The present invention relates to an apparatus for separating cleaning elements, e.g. foam-rubber balls or other particles, from a main stream traversing a heat-exchanger usually of the tube-bundle type. More particularly, the invention relates to improvements in the removal of the cleaning element particles from the collecting sieve provided to intercept these particles in the main stream.

BACKGROUND OF THE INVENTION

It has been proposed to provide foam-rubber balls or other cleaning particles in a main stream of fluid traversing a tube-bundle heat exchanger for cleaning the tubes automatically during the heat-exchange process, thereby eliminating any downtime for such cleaning. It has also been suggested that these particles can be removed from the main stream and recirculated to the latter upstream of the heat exchanger for efficient operation. A device utilizing this self-cleaning technique is described, for example, in U.S. Pat. No. 3,021,117.

A conventional system for recovering the cleaning elements from the main stream traversing a tube-bundle heat exchange can comprise a housing or duct having a sieve (separating sieve) inclined to the axis of the housing and traversed by the fluid. The particles or cleaning elements collect upon this sieve and may be carried away by a collecting tube for reuse.

In the conventional structure of this type, the sieve can be a grate formed by transversely spaced parallel bars and can have a generally ellipsoidal boundary where the sieve meets the wall of the duct or housing. In general, the collecting tube is a radially extending structure which is provided at the low point of the ellipsoidal boundary of the separating sieve to collect the particles which pass downwardly toward this low point.

In practice, however, this system is found to have problems. For example, since the separating seive lies in a plane to the cylindrical housing which can have a vertical axis, the intersection between this plane and the wall of the cylindrical housing or duct defines a wedge or taper so that the passage for the particles has a continuously decreasing cross section to the low point mentioned previously. Because of this configuration, the particles tend to jam together and to block collection of the particles in the collecting tube. Once some particles begin to block the mouth of the collecting tubes, it is necessary to terminate operations until the blockage can be cleared.

OBJECT OF THE INVENTION

It is the object of the present invention to provide a device for recovering cleaning elements of the aforedescribed type from a stream flowing from a heat-exchanger in a self-cleaning operation whereby the aforementioned disadvantage is obviated and a self-blocking of the discharge of the cleaning elements cannot occur.

SUMMARY OF THE INVENTION

This object and others which will become apparent hereinafter are attained, in accordance with the present invention, in an apparatus for separating cleaning elements, e. g. foam-rubber balls or other particles, from the main stream traversing a heat exchange of the tube-bundle type which comprises a vertically oriented cylindrical housing traversed axially by the heat exchanger fluid entraining the particles, and at least one separating sieve built into the housing for intercepting the particles entrained in the stream and recovering them therefrom.

According to the invention, the separating sieve lies in a plane inclined to the axis of the housing and has, at least partially, an ellipsoidal boundary where it meets the inner wall of the housing. At the lower part of this boundary, a collecting tube is provided according to the invention, this tube being formed with a longitudinally extending laterally open slit which is positioned in the main stream so that the axial flow of the latter passes partially tangentially into the collecting tube and induces a vortex movement of fluid therein to draw the particles in through this mouth of the tube, i. e. the aforementioned slit which opens at the plane of the sieve.

According to a feature of the invention, this collecting tube is provided at its low point with a fitting through which the collected particles are removed. According to a feature of the invention, the collecting tube lies along the ellipsoidal boundary of the collecting sieve.

According to still another feature of the invention, the collecting tube is formed in or mounted directly upon the wall of the duct or housing, i. e. is secured to the wall of the housing over its entire length.

The device of the present invention can be provided in various embodiments within the above-described concept. For example, the collecting or edge tube can be formed of a pair of tube sections which converge to the aforementioned low point in the form of a V, the tube sections extending upwardly from this low point along respective portions of the ellipsoidal boundary.

For maximum flow efficiency, the edge tubes can comprise a pair of arcuate tube segments which form portions of the ellipsoid and meet at the aforementioned low point at which the fitting is provided.

Furthermore, the edge or collecting tube (preferably consisting of two tube sections which meet at the aforementioned low point as described) is disposed wholly within the housing or duct although it can be disposed externally of the housing or duct or formed partly through the wall thereof. In the simplest case, the edge tube sections lie along secants of the cylindrical duct, at least in a projection plane through the latter perpendicular to the axis of the duct. In a preferred embodiment of the invention, however, the collecting tube is disposed externally of the housing so that it does not have any significant portion, apart from the region of the aforementioned mouth, lying in the low cross section of the stream. This minimizes the pressure drop within the system.

The most significant advantage of the device according to the invention, as described above, is that the displacement of the cleaning elements or particles from the separating sieve into the collecting tube no longer is strictly passive. As a result of the tangential influx of a portion of the main stream fluid, a suction is created at the mouth of the tube, with respect to which the plane of the sieve lies tangentially, to induce the cleaning elements into this mouth actively.

This suction is a result of the fact that the tangential influx of the main stream fluid generates an intensive vortex within the interior of the tube in the direction of this influx and it is this vortex which produces the suction at the slit or mouth.

This effect does not exclude, of course, the possibility of introducing auxiliary water streams from one or more nozzles into the tube to promote the vortex or amplify the same.

To this end, nozzles can be provided tangentially of the collecting tube and supplied with auxiliary water under pressure. The auxiliary water nozzles can be used, moreover, to create the vortex and an initial suction before the tangential flow of the main stream is generated so that the tangential influx of both the cleaning particles and the portion of the main stream fluid can be initiated.

In either case, the cleaning elements are drawn actively into the slit or mouth of the collecting tube and no longer can accumulate in the crotch or crevice between the sieve and the wall of the housing or duct at the bottom of the ellipsoidal boundary of the sieve. The particles are entrained with the flow of fluid through the collecting tube and are carried off by the discharge fitting.

The term "tube" as used herein to refer to the collecting structure is not intended to be limited to circular-cross section pipes. In fact, any round or even nonround configuration can be employed and even cross sections which tend to the rectangular can be used as long as the aforedescribed vortex or swirl is created. The discharge fitting can be provided with valves or the like to control the diverted quantity of water (with which the cleaning elements are entrained) and hence the suction effect.

BRIEF DESCRIPTION OF THE DRAWING

The above and other objects, features and advantages of the present invention will become more readily apparent from the following description, reference being made to the accompanying drawing in which.

Specific Description

Figure 2:
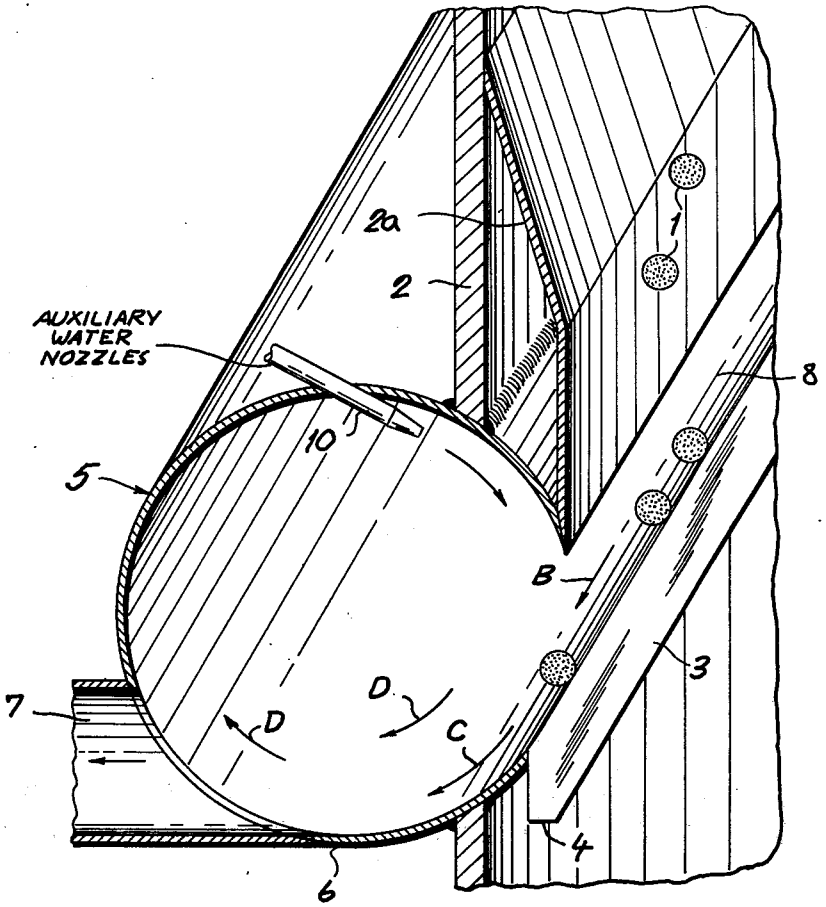
FIG. 2 is a detail view, drawn to a larger scale, of the region II of FIG. 1.
Figure 1:
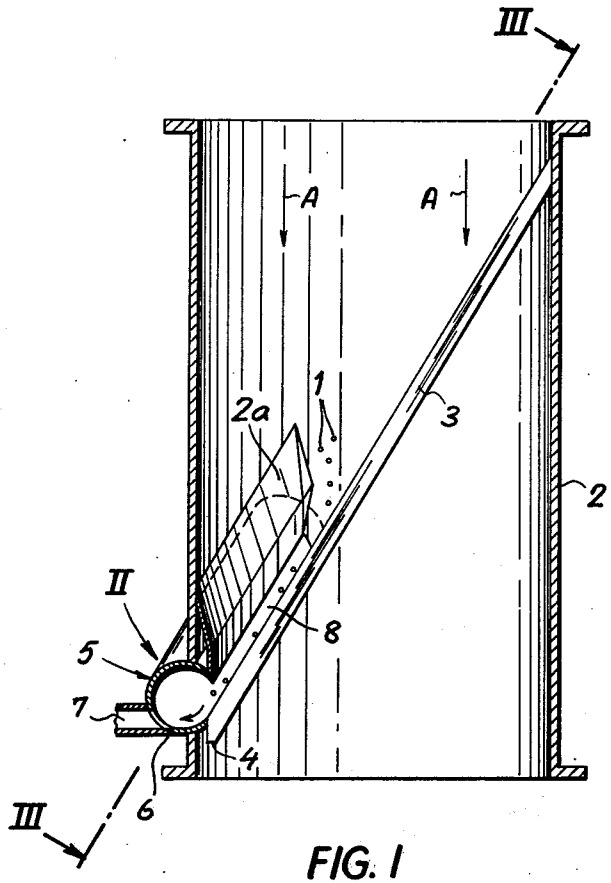
FIG. 1 is an axial cross-sectional view, taken perpendicularly to the plane of the sieve and through the center thereof, somewhat in diagrammatic form, through an apparatus according to the present invention.
Figure 3:
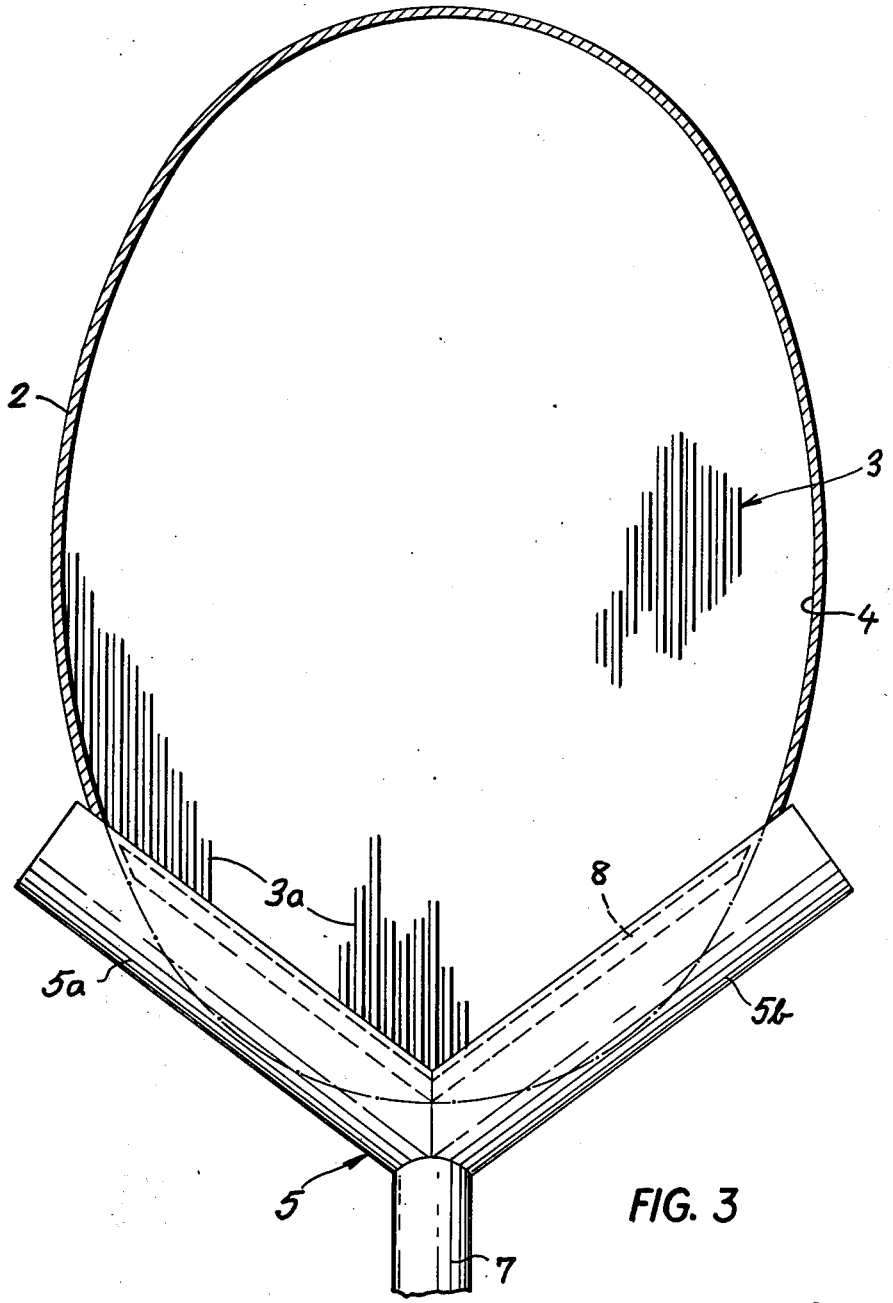
FIG. 3 is a section taken along the line III—III of FIG. 1.

The device illustrated in FIG. 1 through 3 is intended for the removal of cleaning elements 1 in the form of foam-rubber balls, from the main stream of a fluid traversing a tube-bundle heat exchanger. The fluid is usually water and the device illustrated in the drawing is connected at the downstream or discharge side of the heat exchanger. The cleaning elements 1 serve to maintain the interiors of the tubes of the heat exchanger free from accumulations of scale and like contaminants.

The apparatus basically comprises an upright cylindrical housing or duct 2 provided with flanges at its upper and lower end for connection to the discharge side of a tube-bundle heat exchanger and to a pipe through which the fluid is discharged from this heat exchanger. The housing 2 has a vertical axis and conforms to a right-circular cylinder and is traversed by the fluid axially, i.e. in the direction of the arrows A in FIG. 1.

Within the housing 2 there if fixed, e.g. by welding in place, a separating sieve 3 which can consist of an array of transversely spaced parallel bars 3*a* which have been represented only diagrammatically in FIG. 3. The bars 3*a* of the sieve lie in a plane parallel to the section plante III-III and thus the sieve has a generally ellipsoidal boundary where it adjoins the wall of the duct 2. This boundary has been designated at 4 in FIGS. 3 and 4.

As illustrated more clearly in FIG. 1, the separating sieve 3 is inclined to the axis of the housing 2, the ellipsoid 4 corresponding, therefore, to the intersection between a plane and a cylinder, i.e. to a so-called conic section intersection.

On the housing 2, at the bottom of the ellipsoidal boundary 4, there is a provided collecting tube 5 which, in the embodiment of FIGS. 1 through 3, comprises a pair of rectilinear collecting tube sections 5*a*, 5*b* which converge downstream toward a low point 6 at which a fitting 7 (discharge fitting) extends generally radially from the collecting tubes.

Each of the sections 5*a*, 5*b* and hence the collecting tube 5 is provided with a longitudinally extending slit 8 which is best seen in FIG. 2. This slit has a lower edge which is tangential to the upper surface of the sieve 3 while the upper edge lies slightly to the right, i.e. inwardly of the lower edge. As a result, as the fluid passes in the direction of arrow A across the laterally open mouth of the collecting tube 5, there is a tangential influx of liquid as represented by the arrows B and C, creating a vortex as represented by the arrows D, to draw, by the intensive vortex effect, the particles 1 into the mouth by suction. The particles are entrained with the limited quantity of liquid admitted into the tube 5, through the latter and thence through the outlet 7.

Figure 4:
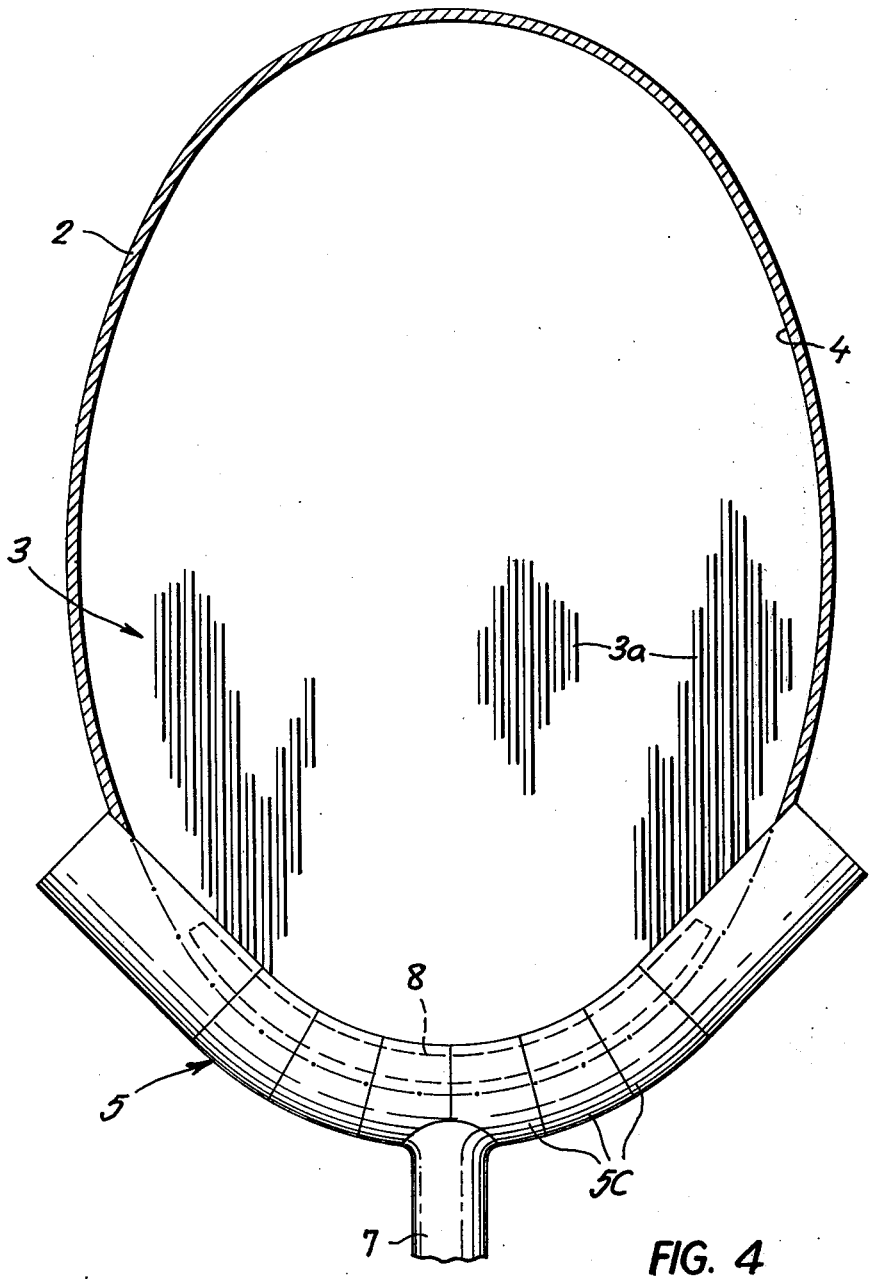
FIG. 4 is a view similar to FIG. 3, but illustrating another embodiment of the invention.

In the embodiment of FIG. 4, instead of rectilinear pipe sections to form the collecting tube 5, the latter is constituted by a plurality of arcuate segments 5*c* so that the arms of the collecting tube, to either side of the discharge fitting 7, more closely conform to the ellipsoidal outline 4 as shown in the region of the bottom of the grate or sieve in dot-dash lines. In the embodiment of FIG. 3, on the other hand, the bottom portion of the outline is embraced within the rectilinear tube sections 5*a* and 5*b*.

As is also apparent from FIGS. 1 and 2, the collecting tube 5 can be mounted substantially within the wall of the housing 2 so that only the slit portion 8 lies within the tube.

Above the tube, and leading to the upper edge of the slit 8, there can be provided a sheet metal hood as represented at 2*a* in FIG. 2. This hood converges from the wall of the tube 2 downwardly toward the grate or sieve 3 to guide the particles 1 to the mouth 8. Auxiliary water nozzles 10 are provided to introduce water jets to establish the vortex represented by arrows D or to increase the suction effect at the mouth 8.

Of course, it is not essential, for the purposes of the present invention, that the sieve or grate 3 completely fill the cross section of the duct 2. For example it is possible to cut the grate short at the top and to match it with an oppositely inclined grate so that the two, with respective collecting tubes, form a roof-like structure. This facilitates the use of a shorter overall structure.

We claim:

1. A device for recovering cleaning elements from a stream of fluid from a heat exchanger, said device comprising:

a cylindrical housing connectible to said heat exchanger and having a vertical axis, said housing being traversed by said fluid downwardly along the axis of said housing;

a separating sieve disposed in said housing and lying at an inclination to said axis while defining with the wall of said housing and at least partially ellipsoidal outline, said sieve approaching said wall at a low point of the sieve;

a collecting tube extending along said outline at said low point and formed with a longitudinal slit receiving cleaning elements from said fluid, said slit being oriented to admit a generally tangential flow of said fluid to induce said elements to pass freely from said sieve into said collecting tube; and a discharge fitting connected to said collecting tube an extending away therefrom.

2. The device defined in claim 1 wherein said discharge fitting extends away from said collecting tube substantially radially with respect to the axis of said housing.

3. The device defined in claim 1 wherein said collecting tube comprises a pair of rectilinear tube sections diverging from said discharge fitting and defining a V which converges toward said low point.

4. The device defined in claim 1 wherein said collecting tube comprises a pair of arms reaching upwardly from said discharge fitting in opposite directions.

5. The device defined in claim 4 wherein said arms are rectilinear.

6. The device claimed in claim 4 wherein said arms are arcuate.

7. The device defined in claim 6 wherein each of said arms is formed a plurality of arcuate tube segments.

8. The device defined in claim 1 wherein said collecting tube is received in said wall of said housing.

9. The device defined in claim 8 wherein the bulk of said collecting tube is disposed externally of said housing.

10. The device defined in claim 4 wherein said slit has a lower edge, said sieve being formed as a grate lying in a plane tangential to said collecting tube at said lower edge, said slit having an upper edge overhanging said lower edge and openly laterally into said housing, said housing being formed with a hood extending inwardly from said wall to said upper edge of said slit, said collecting tube being received in a window formed in said wall and having substantially only a minor portion of the volume from the collecting tube projecting into said housing.

* * * * *